US006068402A

United States Patent [19]

Freese et al.

[11] Patent Number: 6,068,402

[45] Date of Patent: May 30, 2000

[54] FOLDABLE COOLER

[75] Inventors: Brent Freese, Gurnee, Ill.; Donna Finney, Grand Island, N.Y.

[73] Assignee: Outer Circle Products, Ltd., Chicago, Ill.

[21] Appl. No.: 09/179,776

[22] Filed: Oct. 27, 1998

[51] Int. Cl.[7] ..... B65D 30/02

[52] U.S. Cl. ..... 383/110; 383/2; 383/108; 383/113; 383/121.1

[58] Field of Search ..... 383/2, 104, 110, 383/119, 121, 121.1, 113, 108

[56] References Cited

U.S. PATENT DOCUMENTS

| | | | |
|---|---|---|---|
| D. 328,550 | 8/1992 | Mogil et al. . | |
| D. 391,121 | 2/1998 | Melk . | |
| 1,633,991 | 6/1927 | Lifton | 383/121.1 X |
| 2,650,016 | 8/1953 | McMillan . | |
| 3,031,121 | 4/1962 | Chase | 383/2 X |
| 3,129,848 | 4/1964 | Canno . | |
| 3,442,437 | 5/1969 | Mann . | |
| 3,618,478 | 11/1971 | Piazze . | |
| 3,682,372 | 8/1972 | Rodley | 383/104 |
| 4,537,313 | 8/1985 | Workman | 383/110 X |
| 4,679,242 | 7/1987 | Brockhaus | 383/110 X |
| 4,819,793 | 4/1989 | Willard et al. . | |
| 5,401,102 | 3/1995 | Faltynek et al. . | |
| 5,403,095 | 4/1995 | Melk . | |
| 5,472,279 | 12/1995 | Lin | 383/2 |
| 5,490,396 | 2/1996 | Morris | 383/110 X |

*Primary Examiner*—Jes F. Pascua

*Attorney, Agent, or Firm*—McDonnell, Boehnen, Hulbert & Berghoff

[57] ABSTRACT

The present invention provides a novel foldable softwalled cooler for preventing temperature change of heated or cooled items placed therein. The structure generally includes flexible walls having an insulating material therein and a bottom connected to the walls forming a cavity between the walls and the bottom. The inside surface of the walls and the bottom are covered by a water resistant material that is heat sealed at seams so as to prevent leakage at the seams. A panel is provided within the cavity and is likewise covered in a water resistant material. The water resistant material of the panel is heat sealed at the area of connection to the water resistant material of the walls and bottom at a position between the front wall and the bottom. The panel is capable of being positioned either along the bottom surface to provide structural support when food and beverages are placed within the cooler, or it may be placed generally next to the front wall of the cooler so as to not impede the cooler's ability to fold or the cooler's appearance when it is in its folded configuration. A flap extends from a back wall and is capable of overlying at least a portion of the front wall when the cooler is in the folded configuration and acts as a cover when the cooler is in the unfolded configuration.

7 Claims, 5 Drawing Sheets

28
80
72
66
50
20
22c
38
30c
30
74
22b
26
30b
30a
46
6
44
22a
56
30d
22d
70
76
22
82
32
6
32a
34
32d

FOLDABLE COOLER

BACKGROUND OF THE INVENTION

The present application pertains to foldable, flexible walled coolers for preventing a temperature change in hot or cold items placed in such a cooler.

Portable coolers for transporting food and beverages are very popular due to their ability to prevent cooled or heated food and beverages from changing temperature over a period of time. People use these coolers to carry food and beverages when they go to work, to school, to sporting events, to picnics, to go camping, or countless other activities where refrigeration or heating is not easily accessible or possible.

Softwalled coolers have also become very popular of late. Softwalled coolers have many advantages over the standard hardwalled coolers, including their lighter weight, greater portability, and greater comfort when transporting such coolers. These softwalled coolers are typically constructed by sandwiching a section of thermally insulating foam between two pieces of flexible fabric. Several pieces of this sandwiched component are then stitched together to achieve a desired final shape.

More recently, softwalled coolers have been manufactured to be able to fold into a smaller package when not in use. This allows for the cooler to be stored and handled more easily when the cooler is not being used to carry food or beverages.

Problems, however, have arisen in relation to the functionality of these softwalled coolers, both with and without having the capability to fold into a more compact structure. The coolers do not provide the structural support or waterproofing that is commonplace in hardwalled coolers. Structural support is desirable in order to provide ease of movement so that the bottom or floor supporting food and beverages in a softwalled cooler does not sag when the cooler is transported. Waterproofing is also desirable for several reasons. First, when the carrier is used to maintain the temperature of cold items, ice or some other cold medium is used to maintain the cooled temperature. As the ice or other medium melts, water from the ice or condensation from an ice substitute is created which tends to accumulate inside the carrier. Most softwalled carriers tend to leak, as they are sewn together, and the seams become saturated and provide a path for leakage. This leakage may also result in saturation of the thermally insulating material which hinders its ability to provide a thermal barrier.

OBJECTS AND SUMMARY OF THE INVENTION

A general object of the present invention is to provide a foldable softwalled cooler that provides structural support in the bottom of the cooler when food and beverages are placed therein.

Another object of the present invention is to provide a structural support in a foldable softwalled cooler that does not impede the cooler's ability to fold into a smaller package.

A further object of the pre sent invention is to provide a structural support in a foldable softwalled cooler that does not impede with the cooler's outward appearance when the cooler is folded into a smaller package.

Another object of the present invention is to provide a softwalled cooler that is less susceptible to leakage.

Yet another object of the present invention is to provide a softwalled cooler having improved insulating properties.

Briefly, and in accordance with the foregoing, the present invention provides a novel foldable softwalled cooler for preventing temperature change of heated or cooled items placed therein. The structure generally includes flexible walls having an insulating material therein and a bottom connected to the walls forming a cavity between the walls and the bottom. The inside surface of the walls and the bottom are covered by a water resistant material that is heat sealed at seams so as to prevent leakage at the seams. A panel is provided within the cavity and is likewise covered in a water resistant material. The water resistant material of the panel is heat sealed at the area of connection to the water resistant material of the walls and bottom at a position between the front wall and the bottom. The panel is capable of being positioned either along the bottom surface to provide structural support when food and beverages are placed within the cooler, or it may be placed generally next to the front wall of the cooler so as to not impede the cooler's ability to fold or the cooler's appearance when it is in its folded configuration. A flap extends from a back wall and is capable of overlying at least a portion of the front wall when the cooler is in the folded configuration and acts as a cover when the cooler is in the unfolded configuration.

BRIEF DESCRIPTION OF THE DRAWINGS

The features of the present invention which are believed to be novel are set forth with particularity in the appended claims. The organization and manner of the structure and operation of the invention, together with further objects and advantages thereof, may best be understood by reference to the following description taken in connection with the accompanying drawings wherein like reference numerals identify like elements in which:

DETAILED DESCRIPTION OF THE ILLUSTRATED EMBODIMENTS

Figure 1:
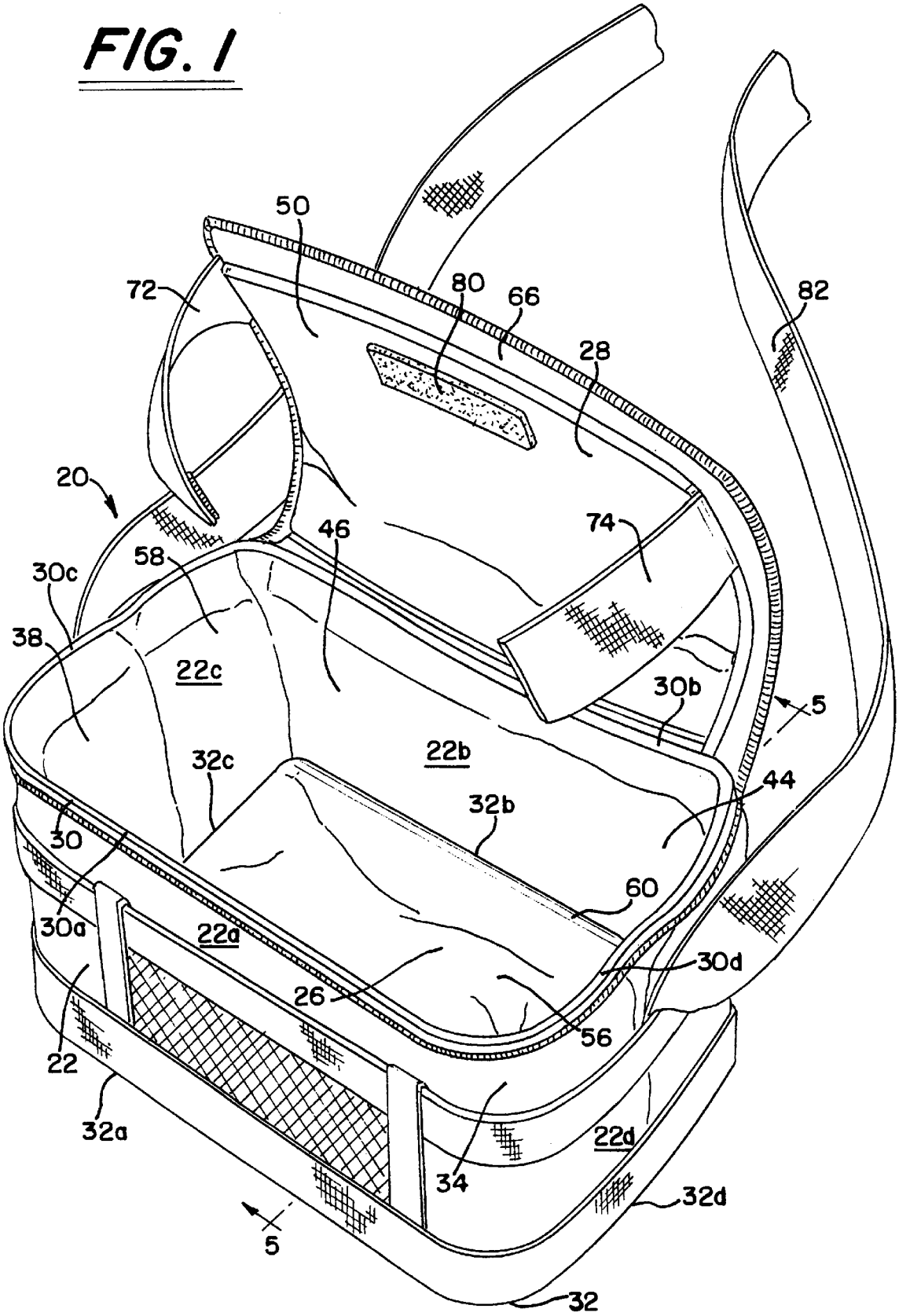
FIG. 1 is a perspective view of a foldable cooler showing the cooler in its open configuration with a flap or cover displaced from covering the cooler and a displaceable panel alongside the bottom.

While the invention may be susceptible to embodiment in different forms, there is shown in the drawings, and herein will be described in detail, a specific embodiment with the understanding that the present disclosure is to be considered an exemplification of the principles of the invention and is not intended to limit the invention to that as illustrated and described herein.

A foldable cooler 20 in accordance with the present invention is shown in FIGS. 1–7. The foldable cooler 20 is provided with a wall portion 22 (having a front 22*a*, a back 22*b*, a left side 22*c*, and a right side 22*d*), a bottom 24, a displaceable panel 26, and a displaceable flap 28.

Figure 5:
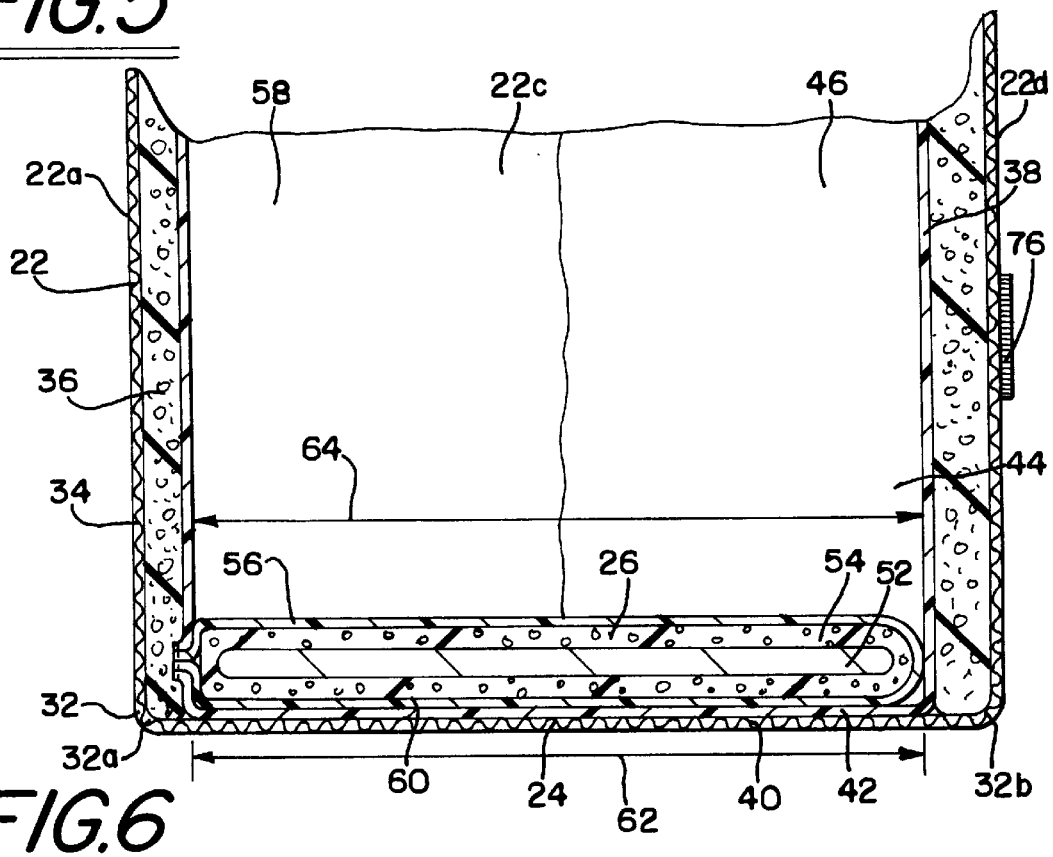
FIG. 5 is a partial fragmentary, cross-sectional side elevational view of the foldable cooler taken along line 5—5 in FIG. 1 showing the cooler in its open configuration and the panel alongside the bottom, the cross-sectional view illustrating a heat sealed connection of the panel to the bottom and the wall.
Figure 6:
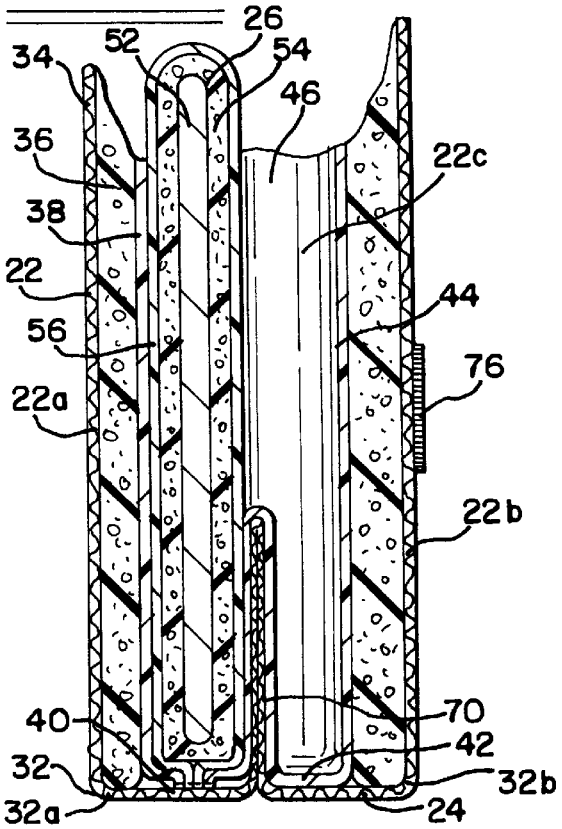
FIG. 6 is a partial fragmentary, cross-sectional side elevational view of the foldable cooler taken along line 6—6 in FIG. 3 showing the cooler in its folded configuration with the panel alongside the inside surface of the front wall, the cross-sectional view illustrating the heat sealed connection of the panel to the bottom and the wall.
Figure 7:
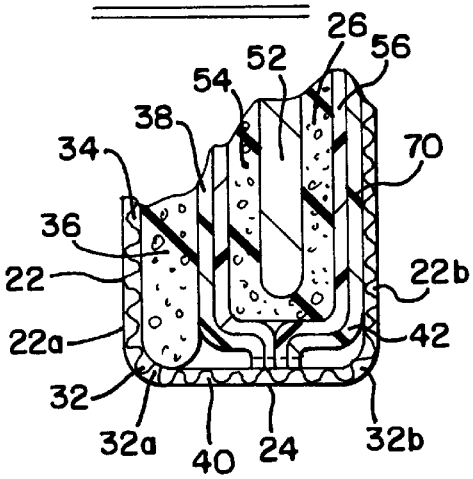
FIG. 7 is an enlarged, partial fragmentary, cross-sectional side elevational view of a portion of the foldable cooler as shown in FIG. 6 showing the cooler in its folded configuration with the panel alongside the wall, the partial cross-sectional view illustrating the heat sealed connection of the panel to the bottom and the wall.

The wall portion 22 has an upper edge 30 (front 30*a*, back 30*b*, left side 30*c*, right side 30*d*) and a lower edge 32 (front 32*a*, back 32*b*, left side 32*c*, right side 32*d*). As best illustrated in FIGS. 5–7, the wall portion 22 is formed of different layers of material, including an outside layer 34, a middle layer 36, and an inside layer 38, the middle layer 36 being sandwiched between the outside layer 34 and the inside layer 38. The outside layer 34 is formed of a flexible, strong material such as nylon. The middle layer 36 is formed of a flexible insulating material. The outside layer 38 is formed of a material having water resistant properties. At least the outside layer 34 and the inside layer 38 are stitched together along the upper edge 30 of the wall portion 22 with the insulating layer 36 retained therebetween. Along the lower edge 32 of the wall portion 22, only the outside layer 34 and the middle layer 36 are stitched together. The inside layer 38 is not stitched to the lower edge 32 of the wall portion 22.

As best illustrated in FIGS. 5–7, the bottom 24 is formed of different layers of material, including an outside layer 40 and an inside layer 42. Unlike the wall portion 22, the bottom 24 does not contain a middle layer formed of an insulating material, for reasons that will be described herein. The outside layer 40 generally is formed of the same material as the outside layer 34 of the wall portion 22. Likewise, the inside layer 42 of the bottom 24 generally is formed of the same material as the inside layer 38 of the wall portion 22. The outside layer 40 of the bottom 24 is connected to the outside layer 34 of the wall portion 22 at the lower edge 32 by stitch. The inside layer 38 of the wall portion 22 and the inside layer 42 of the bottom 24 may be a continuous piece of material or separate pieces of material. In either embodiment, the inside layers 38, 42 are heat sealed at all connecting seams (not shown) so as to prevent leakage in the cooler 20. The heat sealing of the inside layer 38 of the wall portion 22 and the inside layer 42 of the bottom 24 form a bag-like structure 44 defining a cavity 46 between the inner boundaries of the bag-like structure 44. The bag-like structure 44 prevents moisture of liquid present within the cavity 46 from coming into contact with either the middle layer 36 of the wall portion 22 or the out side layers 34, 40 of the wall portion 22 and the bottom 24.

The flap 28 may be formed a s an extension of the back wall portion 22*b*. The flap 28 generally has the same layering construction as the wall portion 22, having an outside layer 48, a middle layer (not shown) and a n inside layer 50. The layers of the flap 28 are made of the same respective materials as those of the three layers 34, 36, 38 of the wall portion 22.

As best illustrated in FIGS. 5–7, the panel 26 is formed of a generally rigid structure 52, an insulating layer 54 covering the generally rigid structure 52, and a water resistant layer 56 covering the insulating layer 54. The insulating layer 54 is preferably made of the same material as that of the middle layer 36 of the wall portion 22. The water resistant layer 56 is made of the same material as that of the inside layer 38 of the wall portion 22. The water resistant layer 56 of the panel 26 may be a continuous piece of material or separate pieces of material. In either embodiment, the water resistant layer 56 is heat sealed at the connecting seams of the panel 26 so as to effectively seal the structure 52 and the insulating layer 54 of the panel 26. The water resistant layer 56 of the panel 26 is also heat sealed to the inside layers 38, 42 at the front lower edge 32*a* of the front wall portion 22*a*.

As illustrated in FIG. 1, the cooler 20 is in its unfolded, open configuration 58. In the open configuration 58, the wall portions 22 of the cooler 20 are unfolded. As illustrated in FIG. 5, the panel 26 lies in a flat position 60 generally abutting against the bag-like structure 44 over the bottom 24 of the cooler 22. The panel 26 is of a length 62 that is generally equal to or less than the length 64 of the bottom 24 from the back lower edge 32*b* of the back wall portion 22*b* to the front lower edge 32*a* of the front wall portion 22*a*, when the cooler 20 is in its open configuration 58. When the panel 26 is in its flat position 60, there is no need for the bottom 24 to have a layer of insulating material because the panel 26 has an insulating layer 54. The panel 26 provides support for beverages, food or anything else carried in the cooler 20, effectively preventing sagging of the bottom 24 when articles are placed in the bottom 24 of the cooler 20. Also, when the cooler 20 is in its open configuration 58, the flap 28 may either be in an open position 66 or in a closed position to cover the cavity 46. In the open position 66, the flap 28 is generally displaced away from the wall portion 22 of the cooler 20, thereby allowing for articles to be placed within the cavity 46 or to be taken out of the cavity 46. In the closed position, the flap 28 is connected to the front, left side, and right side upper edges 30*a*, 30*c*, 30*d* by a zipper (not shown), thereby preventing articles placed within the cavity 46 from escaping the cooler 20.

Figure 2:
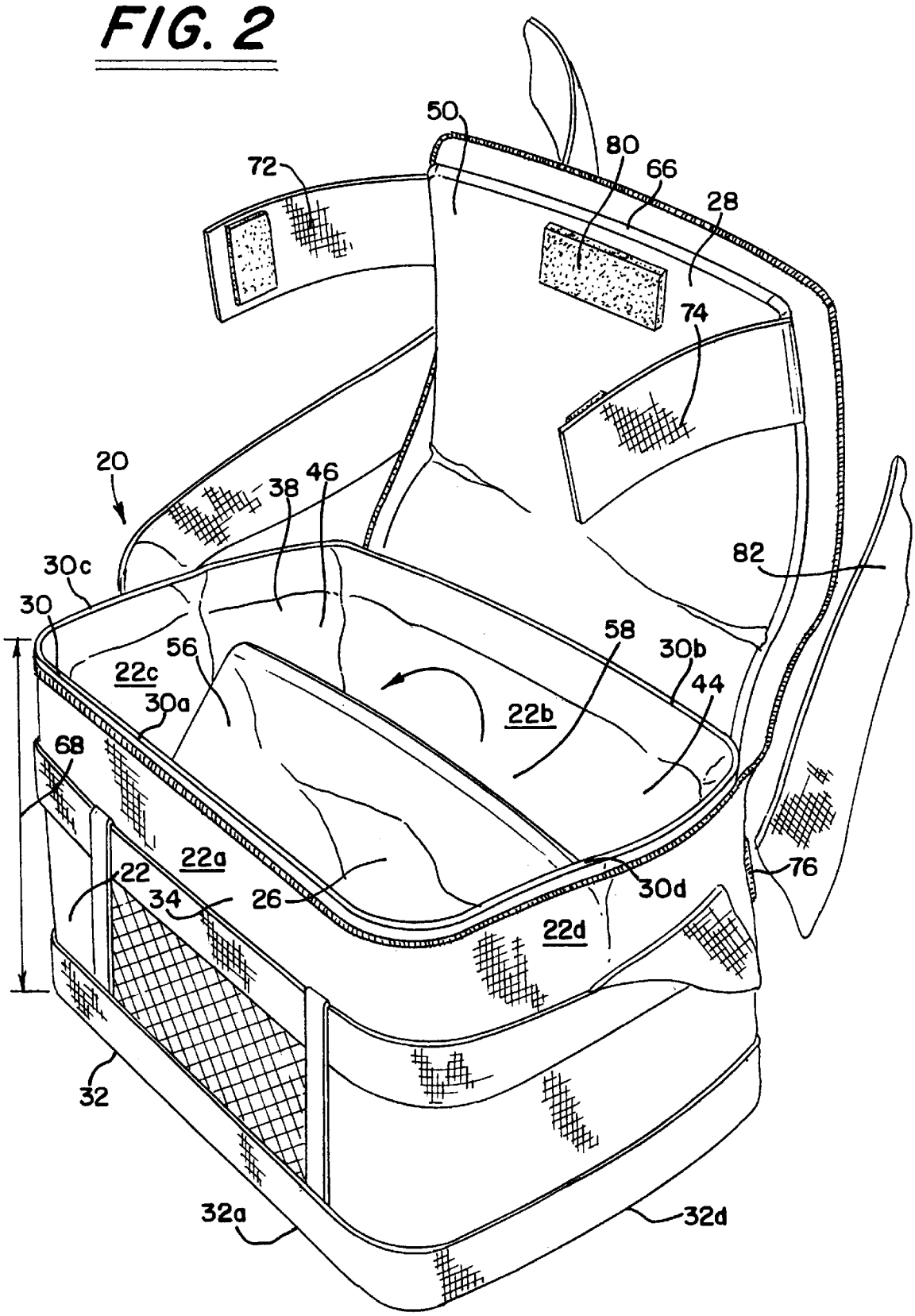
FIG. 2 is a perspective view of the foldable cooler showing the cooler in its open configuration with the flap open and the panel displaced from its position alongside the bottom toward its position alongside the inside surface of the front wall.
Figure 3:
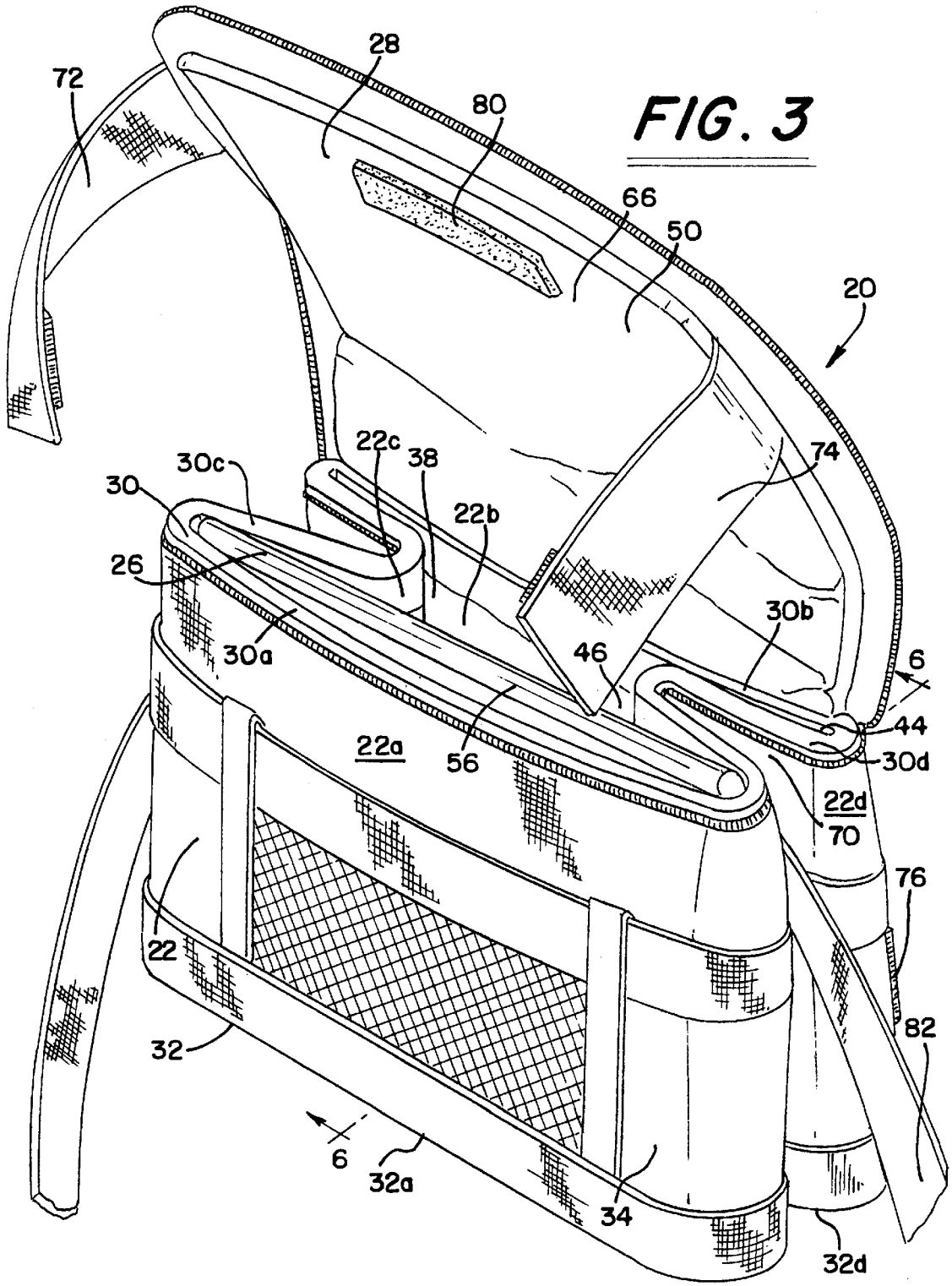
FIG. 3 is a perspective view of the foldable cooler showing the cooler in its folded configuration with the flap open and the panel alongside the inside surface of the front wall.
Figure 4:
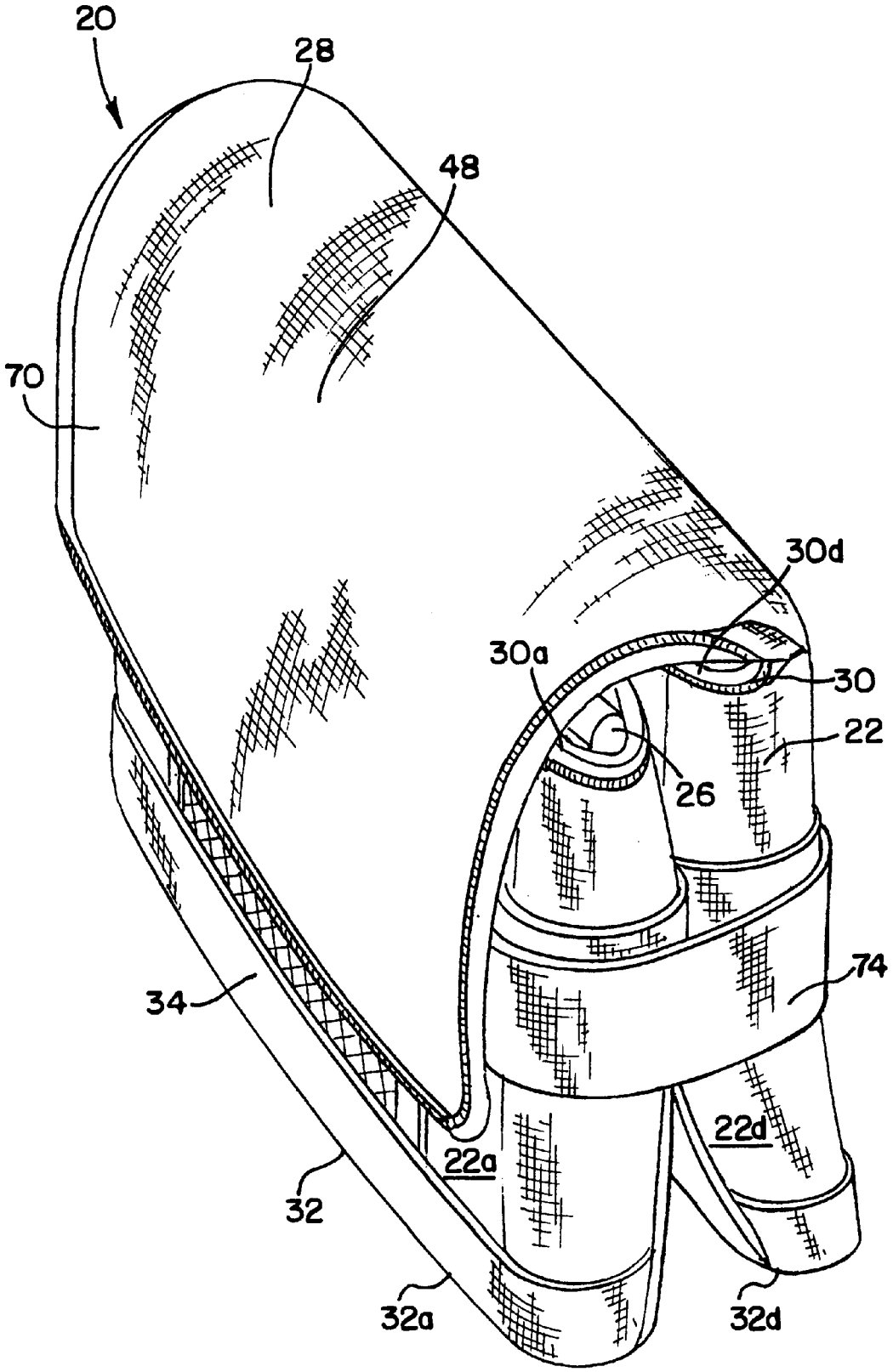
FIG. 4 is a perspective view of the foldable cooler showing the cooler in its folded configuration with the flap closed over the outside surface of the front wall and the panel alongside the inside surface of the front wall.

As illustrated in FIG. 2, to fold the cooler 20 into a more compact package, the flap 28 must be in its open position 66. The user must then displace the panel 26 from the bag-like structure 44 along the bottom 24. The panel 26 is then displaced toward the inside surface of the bag-like structure 44 positioned along the front wall portion 22*a*. As illustrated in FIG. 3, the panel 26 is positioned against the inside surface of the bag-like structure 44 along the front wall portion 22*a* in the cavity 46. The length 62 of the panel 26 is also generally equal to or less than the height 68 of the wall portion 22 from the lower edge 32*a* of the front wall portion 22*a* to the front upper edge 30*a* of the front wall portion 22*a*.

After the panel 26 is situated along the front wall portion 22*a*, the user then folds the left side wall portion 22*c* and the right side wall portion 22*d* into the cavity 46 of the cooler 20. The panel 26 does not impede the folding of the left side wall portion 22*c* and the right side wall portion 22*d* when the panel 26 is situated along the front wall portion 22*a*. The folding of the side wall portions 22*c*, 22*d* effectively acts to move the front wall portion 22*a* and the back wall portion 22*b* closer to each other, compacting the cooler's 20 size. At the same time, as best illustrated in FIG. 6, the bottom 24 is folded into the cavity 46 behind the panel 26 as well. When the bottom 24, the left side wall portion 22*c*, and the right side wall portion 22*d* are all folded, the cooler 20 is in its folded configuration 70.

When the cooler 20 is in its folded configuration 70, the flap 28 closes the cooler 20. The flap 28 covers the cavity 46 as well as a portion of the outside layer 34 of the front wall portion 22*a*. A pair of straps 72, 74, which are attached to the flap 28, respectively wrap around the left side wall portion 22*c* and the right side wall portion 22*d* to connect to a left hook and loop fastener (not shown) and a right hook and loop fastener 76 located on the outside layer 34 of the back wall portion 22*b*. When cooler 20 is in its folded configuration 70 with the flap 28 closing the cooler 20, the cooler 20 is in a very compact package making it easy to store or carry in comparison to a cooler that does not fold. When the flap 28 is not closing the cooler 20, the straps 72, 74 may be connected to a hook and loop fastener 80 located on the inside layer 50 of the flap 28.

A handle 82 may also be connected to the outside layer 34 of the wall portion 22 so that the cooler 20 may more easily be transported when the cooler 20 is in either its open configuration 58 or its folded configuration 70.

While a preferred embodiment of the present invention is shown and described, it is envisioned that those skilled in the art may devise various modifications of the present invention without departing from the spirit and scope of the appended claims. The invention is not intended to be limited by the foregoing disclosure.

What is claimed is:

1. A cooler comprising:

at least one wall having an upper edge and a lower edge, said wall including a first water resistant portion covering an inside surface of said wall;

a bottom connected to said lower edge of said wall, said bottom having a second water resistant portion covering an inside surface of said bottom, said first portion and said second portion being heat sealed together along at least one connecting seam to prevent leakage at said connecting seam, said bottom and said wall defining a cavity therebetween; and a panel positioned in said cavity and connected to said lower edge of said wall adjacent to said first end of said bottom, said panel having a first position and a second position, in said first position said panel generally abutting said inside surface of said bottom, in said second position said panel generally displaced away from said inside surface of said bottom, said panel being covered by a third water resistant portion, said third water resistant portion being heat sealed to the first and second water resistant portions.

2. A cooler as defined in claim 1, wherein said third water resistant portion is heat sealed to said first and second water resistant portions at said lower edge of said wall.

3. A cooler as defined in claim 1, wherein said third water resistant portion is heat sealed to said first and second water resistant portions at said connecting seam.

4. A cooler comprising:

at least one wall having an upper edge and a lower edge, said wall including an insulating material and a first water resistant portion covering an inside surface of said wall;

a bottom connected to said lower edge of said wall, said bottom and said wall defining a cavity therebetween, said bottom having a second water resistant portion covering an inside surface of said bottom, said first and second portions being heat sealed together along at least one connecting seam to prevent leakage at said connecting seam; and a panel positioned in said cavity and connected to a portion of said lower edge of said wall adjacent to said bottom, said panel having a first position and a second position, in said first position said panel generally abutting an inside surface of said bottom, in said second position said panel generally displaced away from said inside surface of said bottom, said panel being covered by a third water resistant portion, said third water resistant portion being heat sealed to said first and second water resistant portions.

5. A cooler as defined in claim 4, wherein said third water resistant portion is heat sealed to said first and second water resistant portions at said lower edge of said wall.

6. A cooler as defined in claim 4, wherein said third water resistant portion is heat sealed to said first and second water resistant portions at said connecting seam.

7. A cooler comprising:

a front wall, a back wall, and side walls, each said wall having an upper edge and a lower edge, each said wall including a first water resistant portion covering an inside surface of each said wall, each said wall including an insulating material, said front wall defining a front wall height between said upper edge of said front wall and said lower edge of said front wall;

a bottom connected to said lower edges of each said wall, said bottom having a second water resistant portion covering an inside surface of said bottom, said bottom defining a bottom length between said lower edge of said front wall and said lower edge of said back wall, said bottom and said walls defining a cavity therebetween;

a panel positioned in said cavity and connected to said lower edge of said front wall adjacent to said bottom, said panel having a first position and a second position, in said first position said panel generally abutting an inside surface of said bottom, in said second position said panel generally abutting an inside surface of said front wall, said panel being covered by a third water resistant portion, said panel being generally rigid and including an insulating material, said panel defining a panel length being generally equal to said front wall height, and said panel length being generally equal to said bottom length;

a flap extending from said upper edge of said back wall, said flap having a pair of straps extending therefrom, said straps capable of being connected to an inside surface of said flap, said flap including an insulating material;

said first and second water resistant portions being heat sealed together along connecting seams to prevent leakage at said connecting seams, said third water resistant portion being heat sealed to said first and second water resistant portions at said lower edge of said front wall along a connecting seam;

said cooler having an open position and a folded position, said side walls and said bottom being foldable;

in said open position, said side walls and said bottom being unfolded, said panel being in said first position, said straps connected to said inside surface of said flap, said flap capable of covering said cavity and attaching to said upper edges of each said wall by a zipper, thereby closing said cooler; and in said folded position, said side walls and said bottom being folded, said panel being in said second position, said flap capable of covering said cavity and an outside surface of said front wall, said straps being connected to an outside surface of said back wall, thereby closing said cooler.

* * * * *